US007365258B1

(12) United States Patent
Lombardi

(10) Patent No.: US 7,365,258 B1
(45) Date of Patent: Apr. 29, 2008

(54) SOUND BOX WITH EXTERNAL AND INTERNAL IMPACT SURFACES

(75) Inventor: Donald G. Lombardi, Westlake Village, CA (US)

(73) Assignee: DruM Workshop, Inc., Oxnard, CA (US)

( * ) Notice: Subject to any disclaimer, the term of this patent is extended or adjusted under 35 U.S.C. 154(b) by 0 days.

(21) Appl. No.: 11/497,448

(22) Filed: Aug. 2, 2006

(51) Int. Cl.
*G10F 1/12* (2006.01)

(52) U.S. Cl. ..... 84/422.1

(58) Field of Classification Search ..... 84/411 R, 84/402, 404, 422.1, 422.2, 422.3, 420
See application file for complete search history.

(56) References Cited

U.S. PATENT DOCUMENTS 3,326,074 A * 6/1967 Osty et al. ..... 84/411 R
4,806,224 A 2/1989 Bruun et al.
5,730,856 A 3/1998 Omasa
6,307,134 B1 * 10/2001 Lombardi ..... 84/411 R

FOREIGN PATENT DOCUMENTS

EP 1 398 195 A 3/2004

* cited by examiner

*Primary Examiner*—Kimberly Lockett
(74) *Attorney, Agent, or Firm*—William W. Haefliger

(57) ABSTRACT

A percussion assembly including a sound box having upright walls, a seat top, and an interior, the assembly comprising a beater located in the box interior, and means to activate the beater to repeatedly beat against a surface of a wall at said interior.

18 Claims, 3 Drawing Sheets

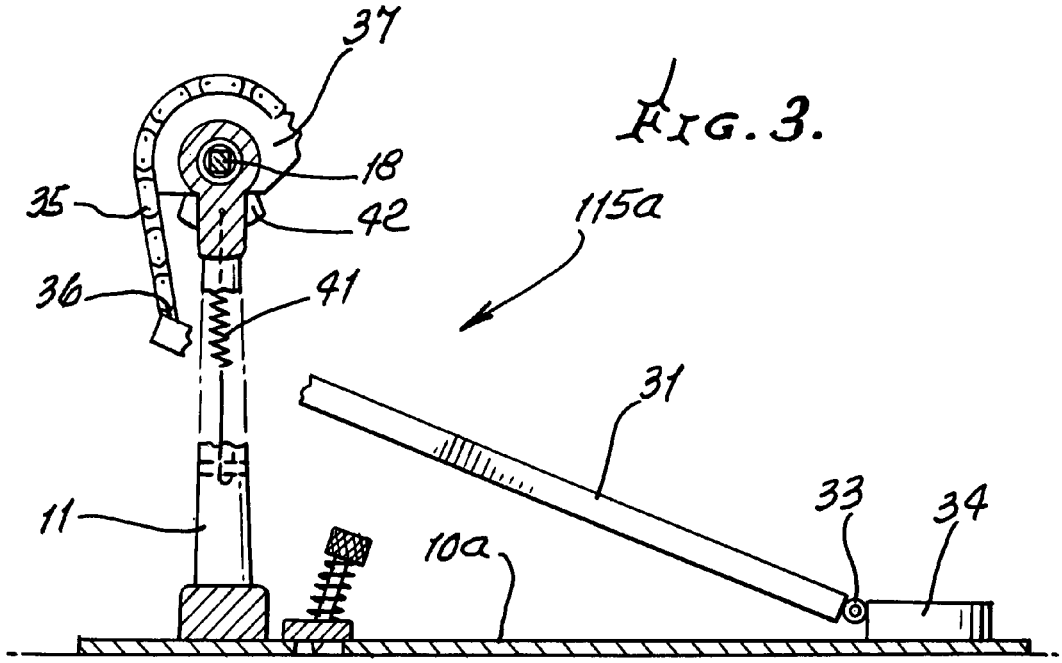
FIG. 3.
FIG. 4.
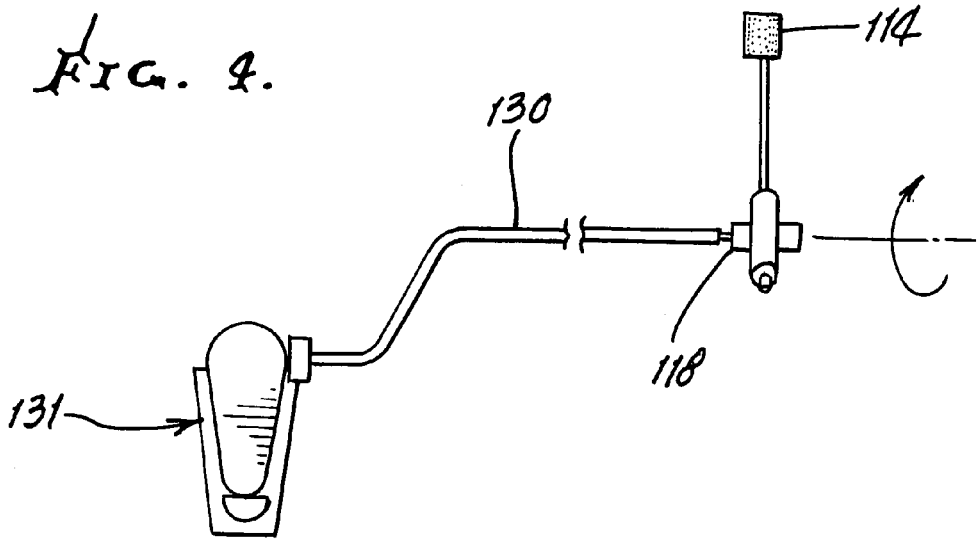

SOUND BOX WITH EXTERNAL AND INTERNAL IMPACT SURFACES

BACKGROUND OF THE INVENTION

This invention relates generally to percussion instruments and more particularly to a percussion assembly including a sound box to be played, i.e. impacted both externally and internally.

Sound boxes have been employed to produce sound as a result of impact against externally presented surfaces, to produce various impact sounds. Typically, a user sits on the box, and his hands are used to impact a side wall or walls of the box, below seat level. There is need for additional rhythmic sound production from such boxes, as for example additional rhythmic effects.

SUMMARY OF THE INVENTION

It is a major object of the invention to provide means meeting the above need. Basically, that object is achieved by employment of:

a) a beater located in the box interior to beat against a box wall, b) and means to activate the beater to repeatedly beat against a surface of a wall at said interior.

Typically, the beater is activated while the user's hand or hands are also being used to impact an external surface of a box wall, whereby the box wall or walls is or are being impacted, rhythmically, both externally and internally.

Another object is to provide said impact receiving wall to have different outer surface portions located to be selectively manually impacted. There may be three of said outer surface portions which, when impacted, produce three different sounds. Also, the wall surface being impacted at the box interior may be located in registration with at least one of said wall outer surface portions, whereby the characteristic sound produced by said surface is multiplied as a result of both external and internal impacting.

An additional object includes provision of a rotary shaft outside the box and extending toward a box wall, and operatively connected to the beater in the box. A foot operated pedal may be operatively connected to the rotary shaft to effect reciprocating rotary shaft movement.

Yet another object is to provide a cable outside the box and extending toward a box wall, the cable operatively connected to the beater in the box, and a foot operated pedal may be operatively connected to that cable outside the box to effect reciprocating rotary cable movement.

A further object includes provision of an additional wall within the box to be repetitively struck by a foot operated beater.

These and other objects and advantages of the invention, as well as the details of an illustrative embodiment, will be more fully understood from the following specification and drawings, in which:

DRAWING DESCRIPTION

FIG. 3 is an elevation showing a pedal unit; and

FIG. 4 is a diagrammatic view showing use of a cable.

DETAILED DESCRIPTION

Figure 1:
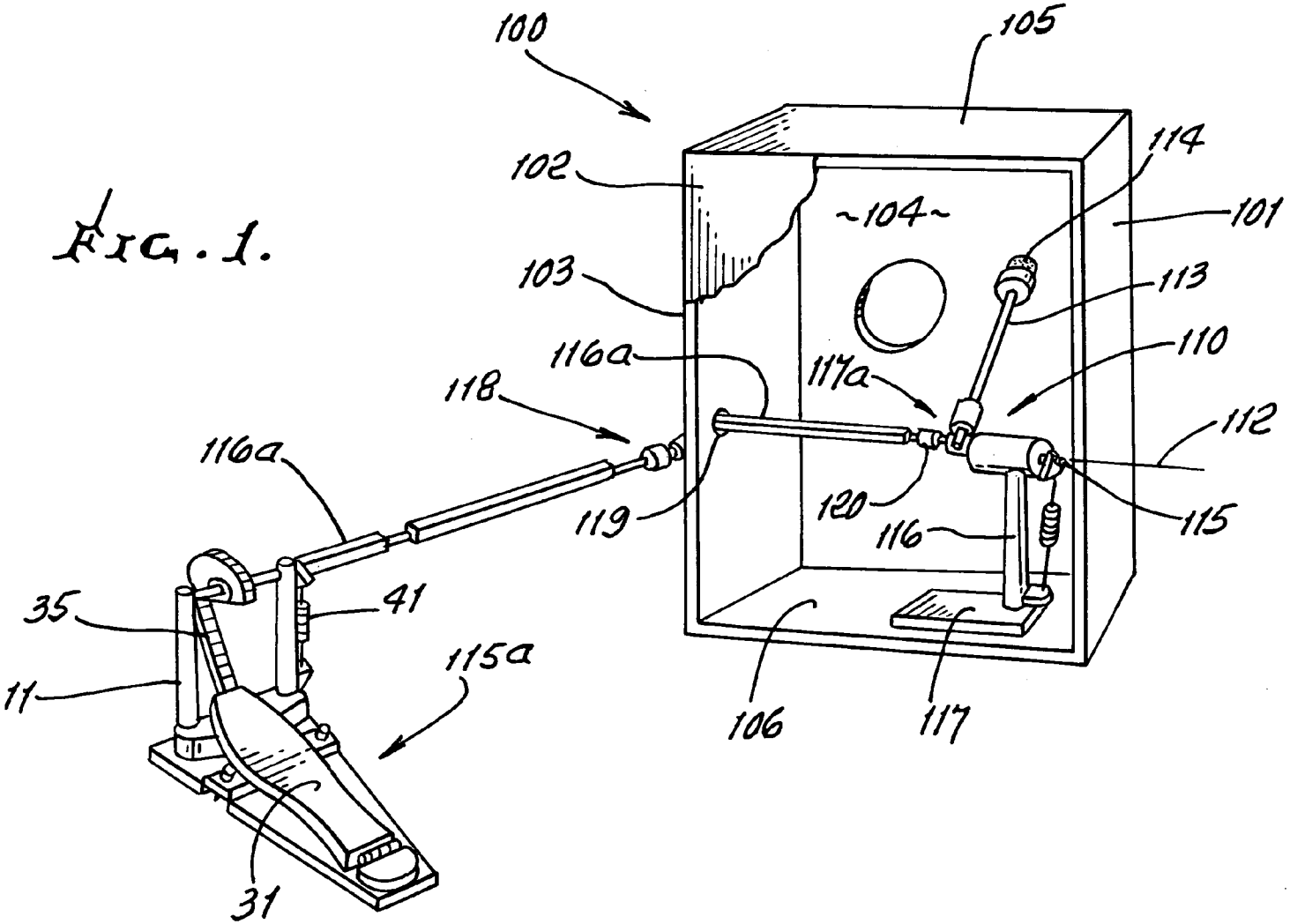
FIG. 1 is a perspective view showing a sound box.

Referring first to FIG. 1, it shows a sound box 100 having upright side walls 101-104, a top wall 105 panel usable as a player's seat, and a bottom wall 106. Such walls and particularly wall 101 may consist of wood, for best sound production, as when wall 101 is impacted manually, by a player seated at 105.

Figure 2:
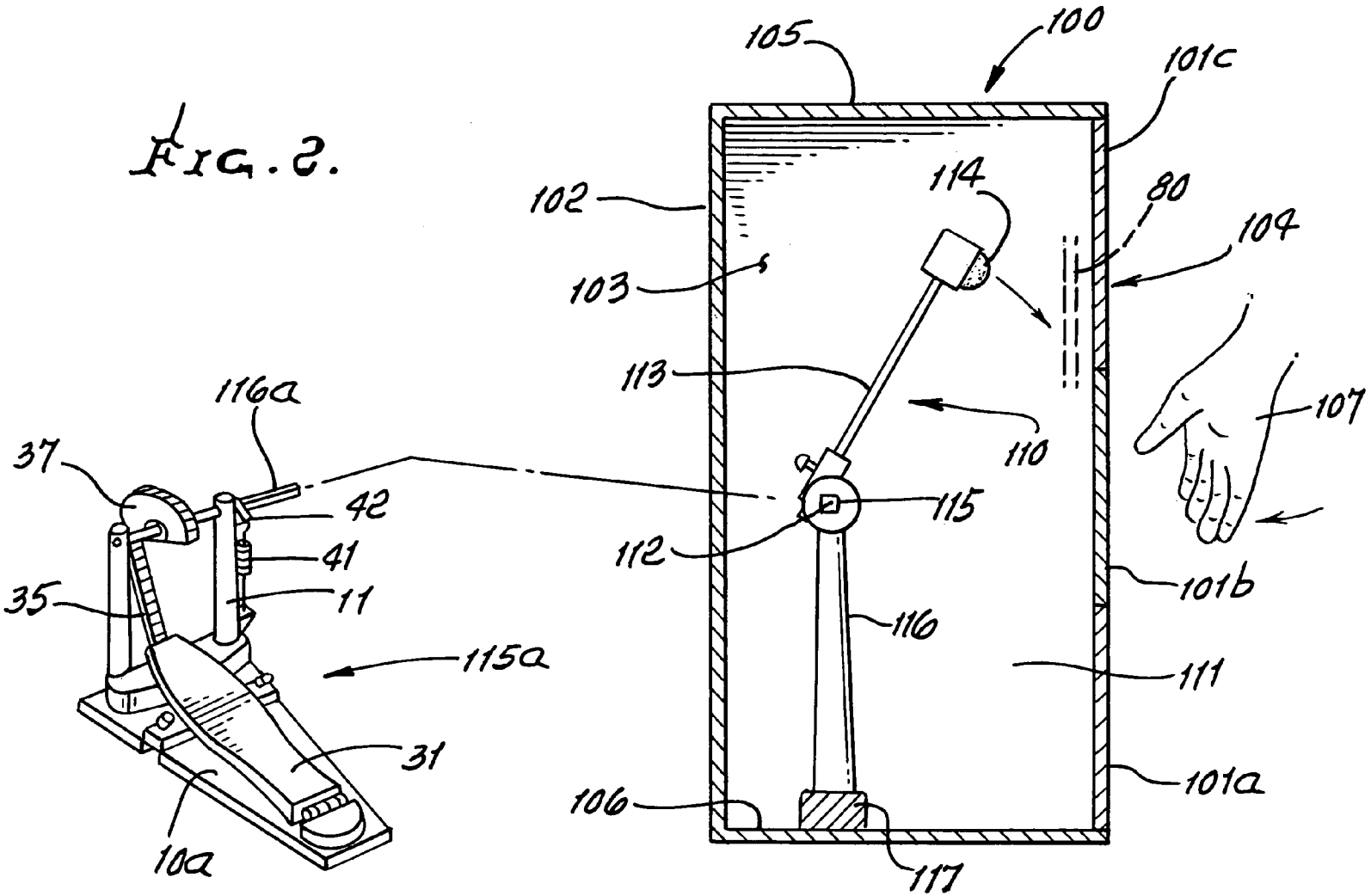
FIG. 2 is a perspective view showing a sound box interior, with beater in that interior, and an exterior operating pedal.

Panel 101 may consist of multiple sections 101*a* and 101*b* and 101*c*, and these differ in such manner that different quality sounds are produced when such panels are selectively manually impacted. FIG. 2 shows a player's hand 107 striking panel 101*b*. The panels may be constructed to produce sound, as follows:

101*a*—higher frequency sound

101*b*—medium frequency sound

101*c*—lower frequency sound

The panels may differentiate as for example in wood used, wood thickness, or panel size, for example.

As also referred to in FIGS. 1 and 2, a beater 110 is located in the box interior as to reciprocate about an axis 112, and beat against wall 104. The beater is shown as including a shaft 113 and a beater head or ball 114, and the beater includes an axle 115 mounted on a pedestal 116, on a base 117, typically connected to panel 106.

The height of the pedestal 116 and length of shaft 113 are such as to cause head 114 to strike one panel such as panel 101*c*, producing a lower or deeper frequency sound, at the same time or at different times, as related to manual striking of one or more of panels 101*a*-101*c*, for optimum rhythmic effect, at the player's control. Typically, he may effect rotation of the beater, as by foot activation of a driver unit 115*a* acting to rotate an activating shaft 116*a* connected to axle 115. Axle 115 may protrude from the wall 103, via a hole 119 in the wall, and may be coupled at 118 to shaft 116*a*. A releasable clamp 120 connects the coupling to protruding axle 115. Other type connections and external and internal drivers may be provided, as a means to activate the beater to repeatedly beat against a surface 104*a* of wall 104, facing box interior 111. As referred to, the wall has different panels, providing different outer surface portions at 101*a*-101*c* located to be selectively manually impacted. The interior surface struck by the beater is typically located in registration with at least one of the outer surface portions.

FIG. 2 shows a foot operated pedal unit 115*a* operatively connected via rotary shaft 116 to effect reciprocating rotary shaft and axle movement. FIG. 4 shows use of a cable 130 between pedal unit 131 and coupling 118.

FIG. 3 shows in detail the construction of a typical pedal unit 115*a*, which includes:

A first pedal 31 operatively connected to a primary axle 18 to rotate that axle in response to pedal pivoting effected by the foot of the drummer.

The pedal 31 is pivoted at 33 to a heel support 34 attached to plate 10*a*. Pivot 33 typically comprises roller bearing means, such as ball bearings, to reduce friction. A flexible coupling, such as chain 35, is connected at 36 to the forward end of the pedal, and extends upwardly to mesh with and wrap on sprocket 37. The latter is fixedly mounted on axle 18, whereby, as the pedal is pushed down, the sprocket and axle 18 are rotated, and the remote beater rotates forwardly, so that head 114 strikes the wall interior surface 104*a*. Yieldable means, such as tension spring 41 is operatively connected between the primary axle and the frame, such as the lower end of pedestal 11, to yieldably resist axle rotation, and return the beater to FIG. 3 position. Note that spring 41 has its upper end connected to crank 42 on shaft or axle 18.

Axle 18 may have square cross section to enable positive connection of a sleeve-type connector to the axle, a set screw also being provided. Annular bearings receive the axle for reception in bearing sleeves.

If desired, the wall to be impacted may be an interior panel as indicated at 80, separate from wall 104.

I claim:

1. A percussion assembly including a sound box having upright walls, a seat top, and an interior, the assembly comprising a) a beater located in the box interior, b) and means to activate the beater to repeatedly beat against a surface of a wall at said interior, said means including a cable outside the box and extending toward a box wall, the cable operatively connected to the beater in the box.

2. The assembly of claim 1 wherein said wall has different outer surface portions located to be selectively manually impacted.

3. A percussion assembly including a sound box having upright walls, a seat top, and an interior, the assembly comprising a) a beater located in the box interior, b) and means to activate the beater to repeatedly beat against a surface of a wall at said interior, c) and wherein said wall has different outer surface portions located to be selectively manually impacted, d) and wherein there are three of said outer surface portions which, when impacted, produce three different sounds.

4. The assembly of claim 3 wherein said wall surface at said interior is located in registration with at least one of said wall outer surface portions.

5. The assembly of claim 1 wherein said means include a rotary shaft outside the box and extending toward a box wall, and operatively connected to the beater in the box.

6. The assembly of claim 5 including a foot operated pedal operatively connected to the rotary shaft to effect reciprocating rotary shaft movement.

7. The assembly of claim 1 wherein said means include a foot operated pedal operatively connected to said cable outside the box to effect reciprocating rotary cable movement.

8. The assembly of claim 5 wherein said box wall defines an opening via which rotary movement is transmitted by the rotary shaft.

9. The assembly of claim 1 wherein said wall surface is separate from a box wall toward which the beater is displaced.

10. The method of producing rhythm, that includes providing the assembly of claim 1, and i) activating the beater as defined in b) claim 1, ii) and manually striking a box wall surface, rhythmically in relation to said step i).

11. A percussion assembly including a sound box having upright walls, a seat top, and an interior, the assembly comprising a) a beater located proximate one of said walls, b) means to activate the beater to repeatedly beat against a surface of said one wall, c) and wherein a wall of the box has different outer surface portions located to be selectively manually impacted.

12. A percussion assembly including a sound box having upright walls, a seat top, and an interior, the assembly comprising a) a beater located proximate one of said walls, b) and means to activate the beater to repeatedly beat against a surface of said one wall, c) and wherein a wall of the box has different outer surface portions located to be selectively manually impacted, d) and wherein there are three of said outer surface portions which, when impacted, produce three different sounds.

13. The assembly of claim 12 wherein said one wall surface is located in proximity with at least one of said wall outer surface portions.

14. A percussion assembly including a sound box having upright walls, a seat top, and an interior, the assembly comprising a) a beater located proximate one of said walls, b) means to activate the beater to repeatedly beat against a surface of said one wall, c) and wherein said means include a rotary shaft outside the box and extending toward said one box wall, and operatively connected to the beater.

15. The assembly of claim 14 including a foot operated pedal operatively connected to the rotary shaft to effect reciprocating rotary shaft movement.

16. The assembly of claim 1 wherein said means include a cable outside the box and extending toward said one box wall, the cable operatively connected to the beater.

17. The assembly of claim 16 wherein said means include a foot operated pedal operatively connected to the cable outside the box to effect reciprocating cable movement.

18. The method of producing rhythm, that includes providing the assembly of claim 1, and i) activating the beater as defined in b) claim 11, ii) and manually striking a box wall surface, rhythmically in relation to said step i).

* * * * *